US008069833B2

(12) United States Patent
Bando

(10) Patent No.: US 8,069,833 B2
(45) Date of Patent: Dec. 6, 2011

(54) RECIPROCATING ENGINE

(75) Inventor: Shigeru Bando, Tokushima (JP)

(73) Assignee: Bando Kiko Co., Ltd., Tokushima-shi, Tokushima (JP)

( * ) Notice: Subject to any disclaimer, the term of this patent is extended or adjusted under 35 U.S.C. 154(b) by 409 days.

(21) Appl. No.: 12/444,484

(22) PCT Filed: Oct. 20, 2006

(86) PCT No.: PCT/JP2006/320972

§ 371 (c)(1),
(2), (4) Date: May 6, 2009

(87) PCT Pub. No.: WO2008/047453

PCT Pub. Date: Apr. 24, 2008

(65) Prior Publication Data

US 2010/0024758 A1 Feb. 4, 2010

(51) Int. Cl.
*F02F 3/00* (2006.01)
*F02F 1/18* (2006.01)
*F02F 3/28* (2006.01)

(52) U.S. Cl. ..... 123/193.4; 123/193.6; 123/193.2

(58) Field of Classification Search ..... 123/193.1–193.6
See application file for complete search history.

(56) References Cited

U.S. PATENT DOCUMENTS 5,050,485 A * 9/1991 Hoult ..... 92/126
5,265,565 A * 11/1993 Bando ..... 123/193.4
5,894,824 A 4/1999 Watanabe et al.
7,464,683 B2 12/2008 Bando
2005/0224038 A1 * 10/2005 Bando ..... 123/193.4

FOREIGN PATENT DOCUMENTS

| | | |
|---|---|---|
| JP | 62-026346 | 2/1987 |
| JP | 4-159441 | 6/1992 |
| JP | 4-321757 | 11/1992 |
| JP | 4-347353 | 12/1992 |
| JP | 4-362258 | 12/1992 |
| JP | 5-005459 | 1/1993 |
| JP | 5-26106 | 2/1993 |
| JP | 5-033865 | 2/1993 |
| WO | WO 93/06356 | 4/1993 |
| WO | WO 97/42406 | 11/1997 |
| WO | WO 2004/001215 A1 | 12/2003 |
| WO | WO 2004/079177 A1 | 9/2004 |
| WO | WO 2006/118165 A1 | 11/2006 |

OTHER PUBLICATIONS

U.S. Appl. No. 11/918,878, filed Oct. 19, 2007 (counterpart of WO 2006/118165).

* cited by examiner

*Primary Examiner* — M. McMahon
(74) *Attorney, Agent, or Firm* — Nixon & Vanderhye P.C.

(57) ABSTRACT

A piston 2 includes a piston upper body 8 made up of a crown portion 3 for receiving combustion pressure and a land portion 7 having piston ring grooves 4, 5, and 6, as well as a skirt portion 9 formed on the lower side of the piston upper body 8, and a pin boss portion 11 for supporting a piston pin 10. The land portion 7 also includes an outer peripheral surface 16 of the aforementioned piston upper body 8. The land portion 7 is referred to as the outer peripheral surface 16 of the piston upper body 8. In the piston 2, reference numeral 12 denotes a thrust side, and reference numeral 13 denotes an anti-thrust side. The piston 2 is formed such that the piston upper body 8 is off-centered toward the anti-thrust side 13 with respect to a center line 14 of the piston 2.

1 Claim, 12 Drawing Sheets

RECIPROCATING ENGINE

This application is the U.S. national phase of International Application No. PCT/JP2006/320972, filed 20 Oct. 2006, which designated the U.S. entire contents of which are hereby incorporated by reference.

TECHNICAL FIELD

The present invention relates to a reciprocating engine in which, during operation, a piston is lowered while the piston is supported by gas pressure from a thrust side toward an anti-thrust side and is thereby closely abutted against a cylinder wall on the anti-thrust side so that the piston does not undergo runout such as oscillation, swinging, and lateral runout, thereby attaining reduction of the friction loss between the piston and a cylinder and the friction loss between the piston and piston rings.

The present invention concerns a reciprocating engine which can naturally be used as a four-cycle gasoline engine, a two-cycle gasoline engine, or a diesel engine.

BACKGROUND ART

Patent Document 1: Pamphlet of International Publication No. WO 92/02722
Patent Document 2: JP-A-04-347352
Patent Document 3: JP-A-05-26106
Patent Document 4: Japanese Patent No. 2988010

Techniques for reducing the friction loss between the piston and the cylinder on the thrust side due to thrust force acting on the piston include, among others, a pamphlet of International Publication No. WO 92/02722, JP-A-04-347352, JP-A-05-26106, and Japanese Patent No. 2988010 (Refer to Patent Documents 1 to 4). In the techniques described therein, a gas chamber is formed between piston rings for compression provided on a piston upper body, i.e., on a second land portion, and high pressure gas above the piston is introduced into this gas chamber in an initial stage of the expansion stroke of the engine operation, such that the piston is supported by this introduced gas pressure in opposition to the thrust force generated due to the tilting of a connecting rod, to thereby attain reduction of the friction loss between the piston and an inner surface of the cylinder.

DISCLOSURE OF THE INVENTION

Problems to be Solved by the Invention

Incidentally, the diameter of the piston upper body of the reciprocating engine is smaller than that of a maximum-diameter portion of a skirt portion, and the piston as a whole has a trapezoidal shape. Namely, the piston upper body is incorporated into the cylinder with a clearance with respect to the inside diameter of the cylinder. In other words, a clearance is inevitably present between the piston upper body of the piston and the inner surface of the cylinder on both the thrust side and the anti-thrust side. For this reason, the swinging phenomenon of the piston at the top dead center remains unchanged even if the gas chamber is formed between the piston rings for compression, i.e., on the second land portion, and the high pressure gas above the piston is introduced into this gas chamber in the initial stage of the expansion stroke so as to support the piston by this introduced gas pressure. Namely, owing to the presence of the above-described clearance, the piston undergoes oscillation and swinging due to the moment load and thrust force during the engine operation, particularly during the inversion at the top dead center. The piston upper body and the skirt portion of the piston collide against the cylinder. For this reason, the friction loss is caused between the piston and the cylinder, between the piston ring and the cylinder, and between the piston ring and the piston ring groove. In addition, the runout of the piston results in the occurrence of blowby gas.

Accordingly, an object of the invention is to provide a reciprocating engine which, during the engine operation, is capable of suppressing the runout of the piston, including the oscillation, swinging, lateral runout, and the like of the piston, of attaining the reduction of the friction loss between the piston ring and the cylinder and between the piston ring and the piston groove and the reduction of the occurrence of blowby gas, and of enhancing the effective cooling of the piston upper body and the combustion rate of the fuel mixture.

Means for Solving the Problems

In accordance with the invention, a reciprocating engine having a piston comprises: a piston upper body made up of a crown portion for receiving combustion pressure and a land portion having piston rings fitted thereon; and a skirt portion formed on a lower side of the piston upper body, wherein the piston upper body is formed so as to be off-centered toward an anti-thrust side with respect to a center line of a piston, and, on the anti-thrust side an outer peripheral surface of the piston upper body and an outer peripheral surface of a maximum-diameter portion of the skirt portion are formed by being aligned on a vertical line, such that, in a state in which the piston is accommodated in an upright posture in a cylinder, on the anti-thrust side the outer peripheral surface of the piston upper body and the outer peripheral surface of the maximum-diameter portion of the skirt portion are in close abutment against with an inner surface of the cylinder, and on a thrust side a clearance is created between the outer peripheral surface of the piston upper body and an inner surface of the cylinder, a gas chamber being formed on a second land portion between a first piston ring fitted on the outer peripheral surface of the piston upper body and a second piston ring, a plurality of recesses being formed in an upper portion on the thrust side of the inner surface of the cylinder, whereby when the piston is located at a top dead center or in a vicinity of the top dead center, high pressure gas above the piston is allowed to flow into the annular gas chamber, the piston is supported from the thrust side by the high pressure gas flowing into the gas chamber, and the piston is lowered such that the outer peripheral surface of the piston upper body and the skirt portion are in abutment with the inner surface of the cylinder on the anti-thrust side.

According to the above-described construction, the piston upper body is off-centered toward the anti-thrust side, and the outer peripheral surface of the piston upper body and the outer peripheral surface of the maximum-diameter portion of the skirt portion are formed by being aligned on the vertical line. Therefore, as for the piston incorporated in the cylinder, on the anti-thrust side in the upright posture, the outer peripheral surface of the piston upper body and the outer peripheral surface of maximum-diameter portion of the skirt portion are in a state of being in close abutment with the inner surface of the cylinder.

When the piston in the above-described state is at the top dead center, if the compressed gas and the expansion gas act on the top surface, the gas pressure acts on the outer peripheral surface on the thrust side of the piston upper body, but cannot act around onto the outer peripheral surface on the anti-thrust side, i.e., onto the top land on the anti-thrust side. The piston is set in a state of being supported from the thrust side.

Even if a moment load which would swing the piston in such a state is applied to the piston, the piston inscribes the inner surface of the cylinder on the anti-thrust side while maintaining its upright posture. When the piston is in the above-described state at the top dead center or in the vicinity of the top dead center, the expansion gas above the piston flows into the annular gas chamber of the piston through the recesses provided on the upper portion on the thrust side of the inner surface of the cylinder. At this time, a thrust force or lateral pressure acts on the piston owing to the tilting of a connecting rod toward the thrust side, and tends to cause lateral runout toward the thrust side. However, the piston is supported from the thrust side by the gas which flowed into and held in the annular gas chamber, and is lowered with its runout suppressed while maintaining its upright posture and abutting against the inner surface of the cylinder on the anti-thrust side.

Namely, the piston is in close abutment with the anti-thrust side due to the resilient support and pressing from the thrust side by the gas pressure. For this reason, the piston is suppressed from undergoing lateral runout, swinging, and collision against the cylinder. Accordingly, it is possible to substantially reduce the friction loss between the piston and the cylinder, particularly between the piston and the cylinder on the thrust side where lateral pressure acts, between the piston ring and the piston, and between the piston ring and the cylinder inner surface. In addition, since the vibration of the piston is suppressed, it is possible to prevent the blow through of the blowby gas.

Furthermore, as for the piston, since the piston upper body having the crown portion, which is subjected to the high-temperature, high-pressure gas pressure, is in contact with the cylinder on the anti-thrust side, as compared with the conventional contact with the cylinder by only the piston rings, the area of contact with the cylinder increases widely, and the flow of heat from the piston to the cylinder is large, thereby allowing the cooling of the top surface of the piston to be performed effectively. Therefore, it is possible to prevent abnormal combustion, and the heat rise of the overall engine is low, so that absorption efficiency can be secured satisfactorily.

In addition, in the initial stage of the expansion stroke, when the piston is located at the top dead center or in the vicinity of the top dead center, and the first piston ring of the piston passes over the plurality of recesses, the pressure of the gas being burned above the piston rapidly flows into the annular gas chamber of the piston, so that flow occurs in the gas being burned above the piston, and that gas is disturbed, thereby increasing the combustion rate and diminishing the combustion time.

Advantages of the Invention

According to the invention, it is possible to provide a reciprocating engine in which, during the engine operation, is capable of suppressing the runout of the piston, including the oscillation, swinging, lateral runout, and the like of the piston, of attaining the reduction of the friction loss between the piston ring and the cylinder and between the piston ring and the piston groove and the reduction of the occurrence of blowby gas, and of enhancing the effective cooling of the piston upper body and the combustion rate of the fuel mixture.

Hereafter, a description will be given of the embodiments with reference to the drawings illustrating the mode for carrying out the invention.

BEST MODE FOR CARRYING OUT THE INVENTION

FIGS. 1 to 9 show a first embodiment of a reciprocating engine in accordance with the invention. FIGS. 10 to 14 show a second embodiment of the reciprocating engine in accordance with the invention.

Figure 5:
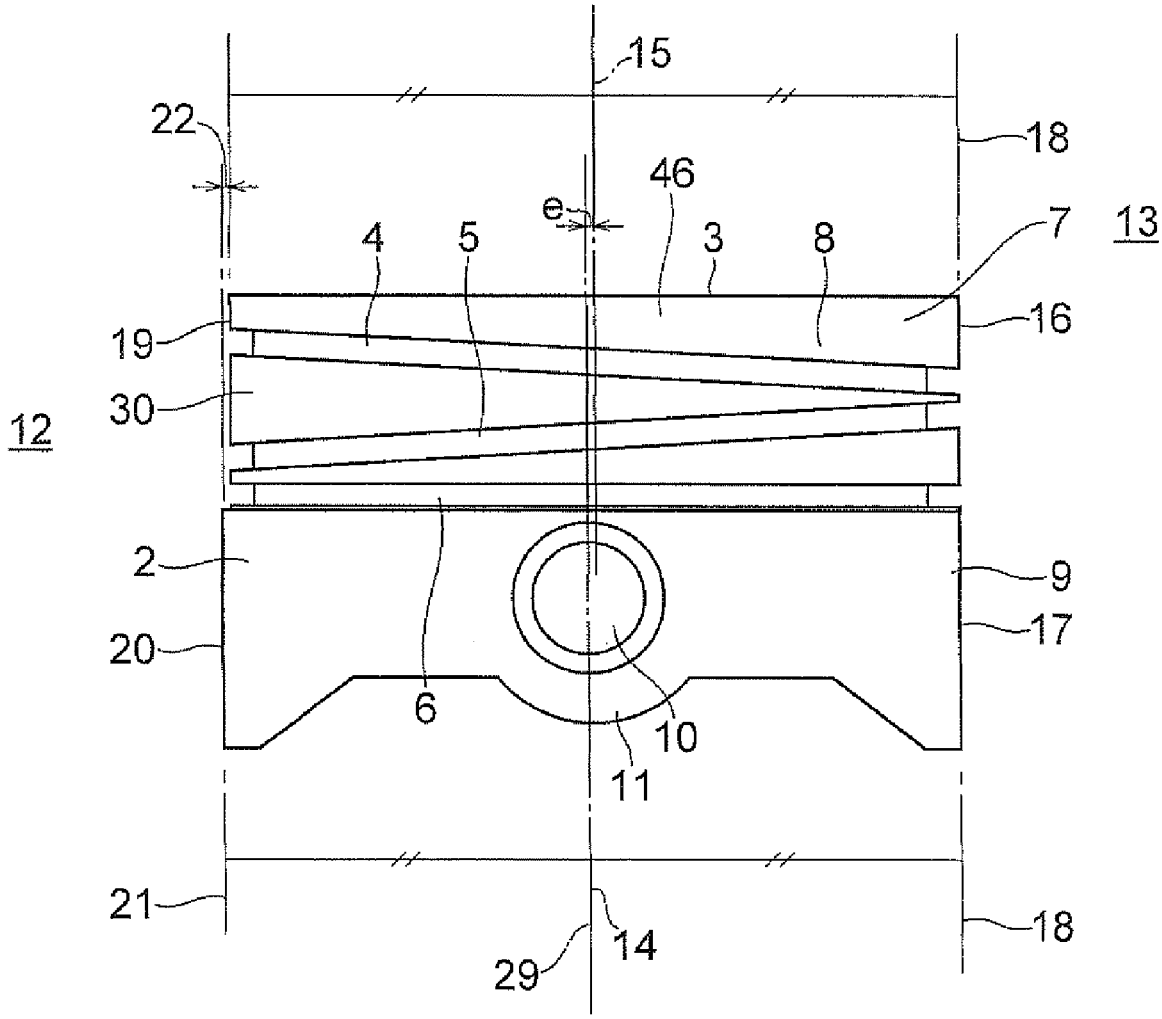
FIG. 5 is an explanatory diagram of a piston in accordance with the example shown in FIG. 1.
Figure 6:
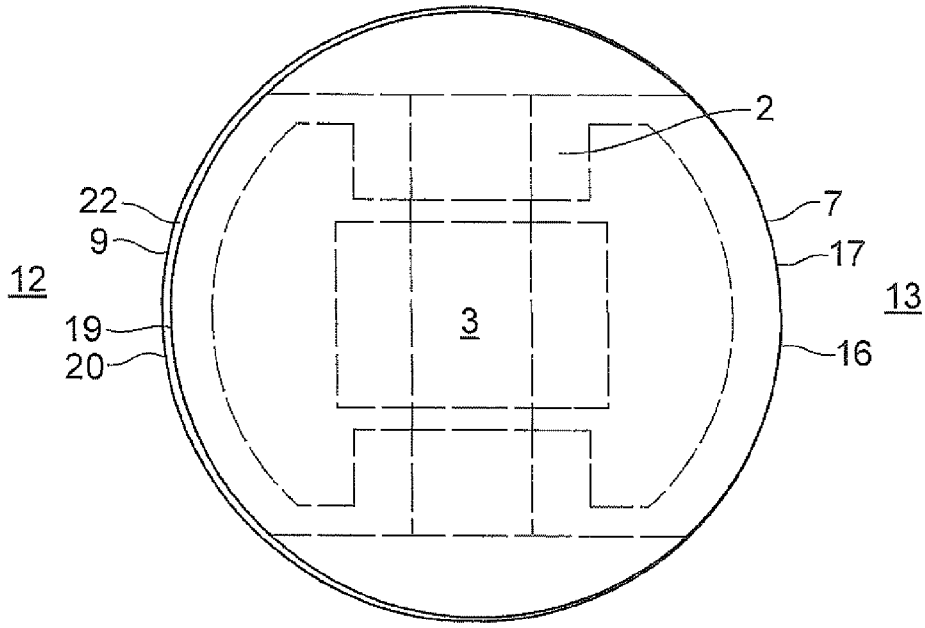
FIG. 6 is a plan view of the piston in accordance with the example shown in FIG. 5.

FIGS. 5 and 6 show a piston 2 of a reciprocating engine 1 in accordance with the first embodiment. The piston 2 includes a piston upper body 8 made up of a crown portion 3 for receiving combustion pressure and a land portion 7 having piston ring grooves 4, 5, and 6; a skirt portion 9 formed on the lower side of this piston upper body 8; and a pin boss portion 11 for supporting a piston pin 10. It should be noted that the aforementioned land portion 7 is meant to include an outer peripheral surface 16 of the aforementioned piston upper body 8 as well. Hereafter, the land portion 7 will be referred to as the outer peripheral surface 16 of the piston upper body 8. In the aforementioned piston 2, reference numeral 12 denotes a thrust side, and reference numeral 13 denotes an anti-thrust side.

The piston 2 is formed such that the aforementioned piston upper body 8 is off-centered toward the anti-thrust side 13 with respect to a center line 14 of the piston 2. Reference numeral 15 denotes a center line of the piston upper body 8. As shown in FIG. 5, the piston 2 in an upright posture is formed such that on the anti-thrust side 13, the outer peripheral surface 16 of the piston upper body 8 and an outer peripheral surface 17 of a maximum-diameter portion of the skirt portion 9 are aligned on a vertical line 18.

Meanwhile, on the thrust side 12, an outer peripheral surface 19 of the piston upper body 8 is located inwardly of a vertical line 21 passing through an outer peripheral surface 20 of the maximum-diameter portion of the skirt portion 17, so that there is a clearance 22 therebetween.

Figure 1:
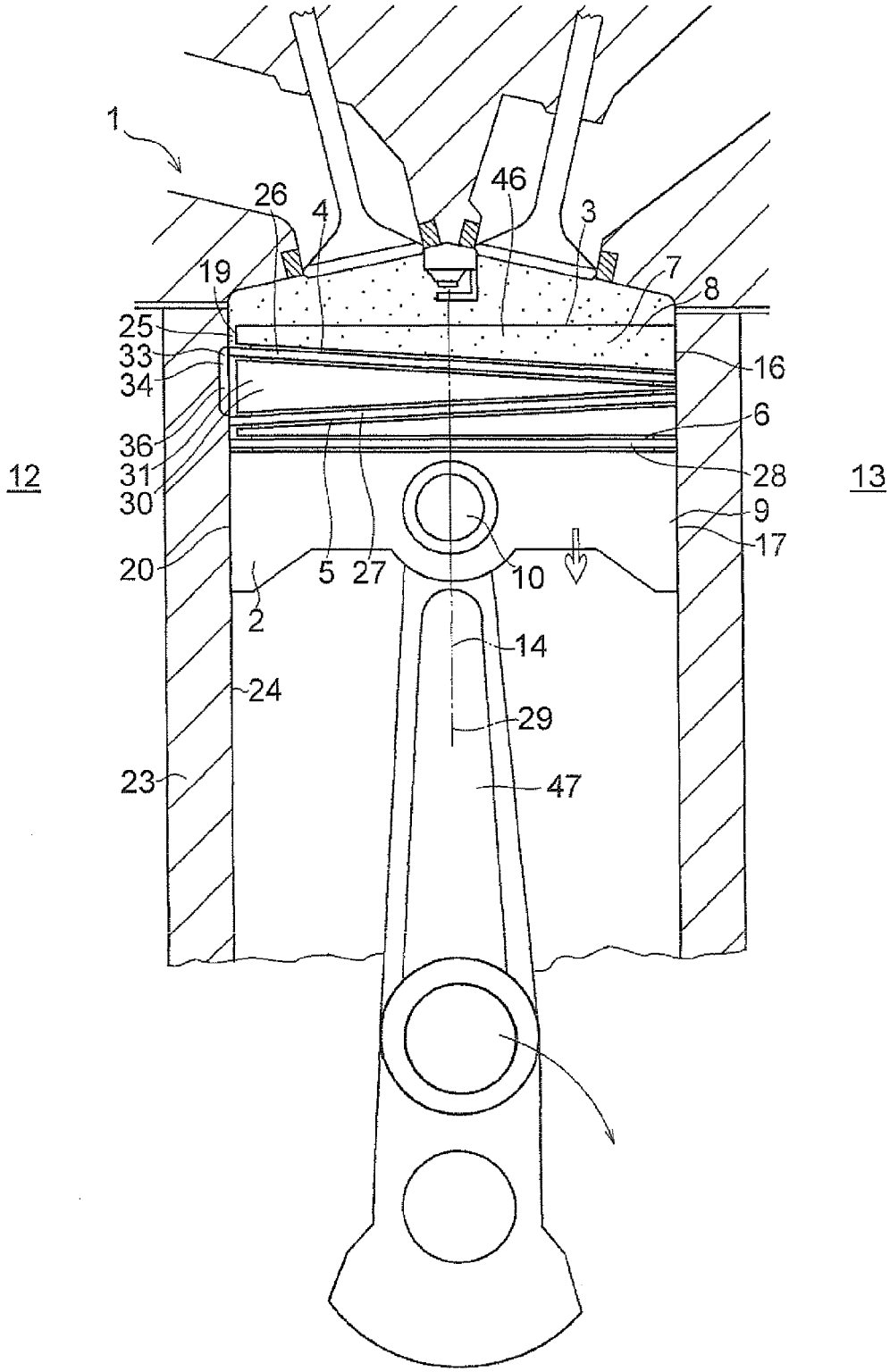
FIG. 1 is an explanatory longitudinal cross-sectional view of an example of the mode for carrying out the invention.
Figure 2:
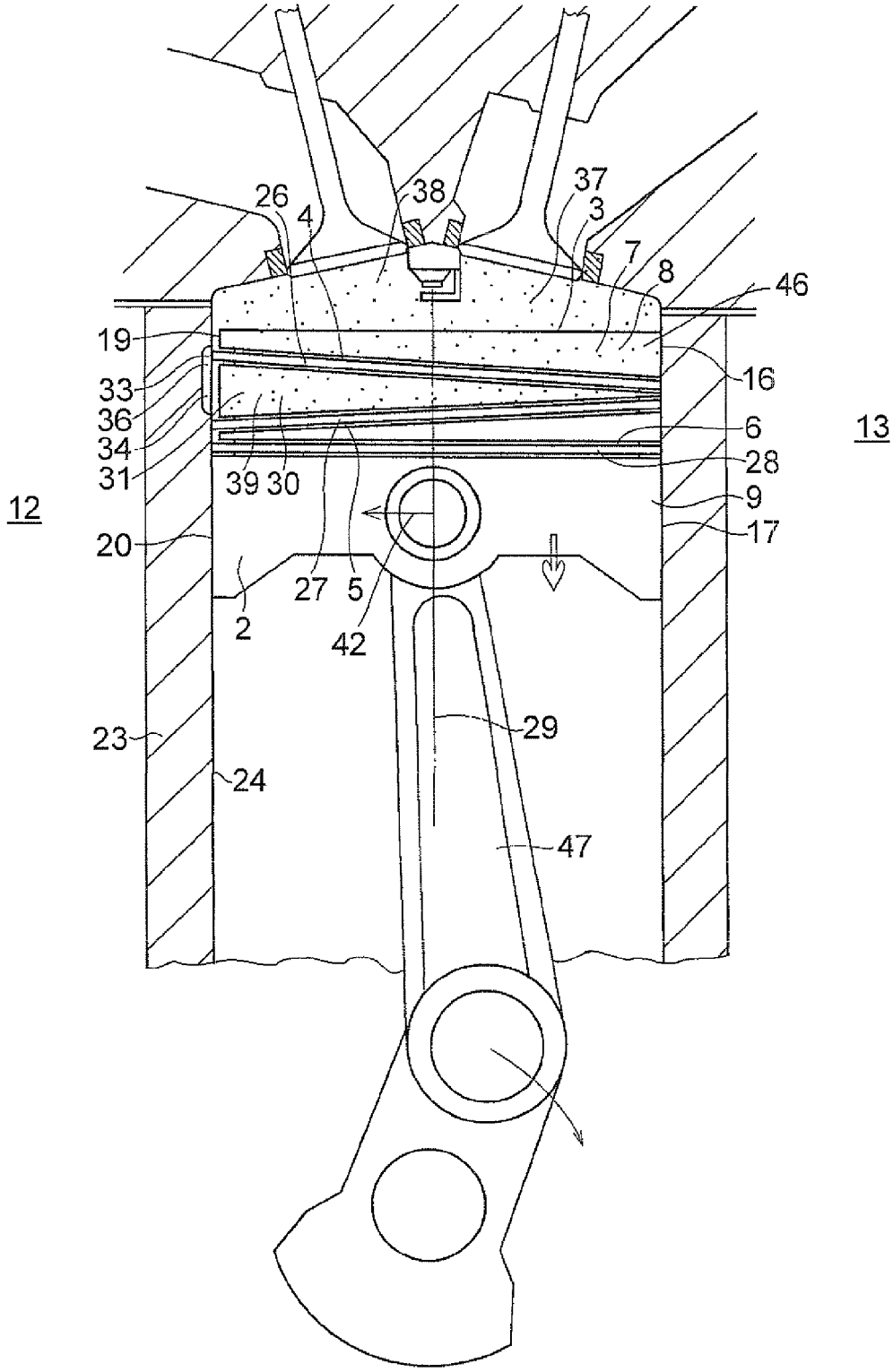
FIG. 2 is an explanatory diagram of operation in accordance with the example shown in FIG. 1.
Figure 3:
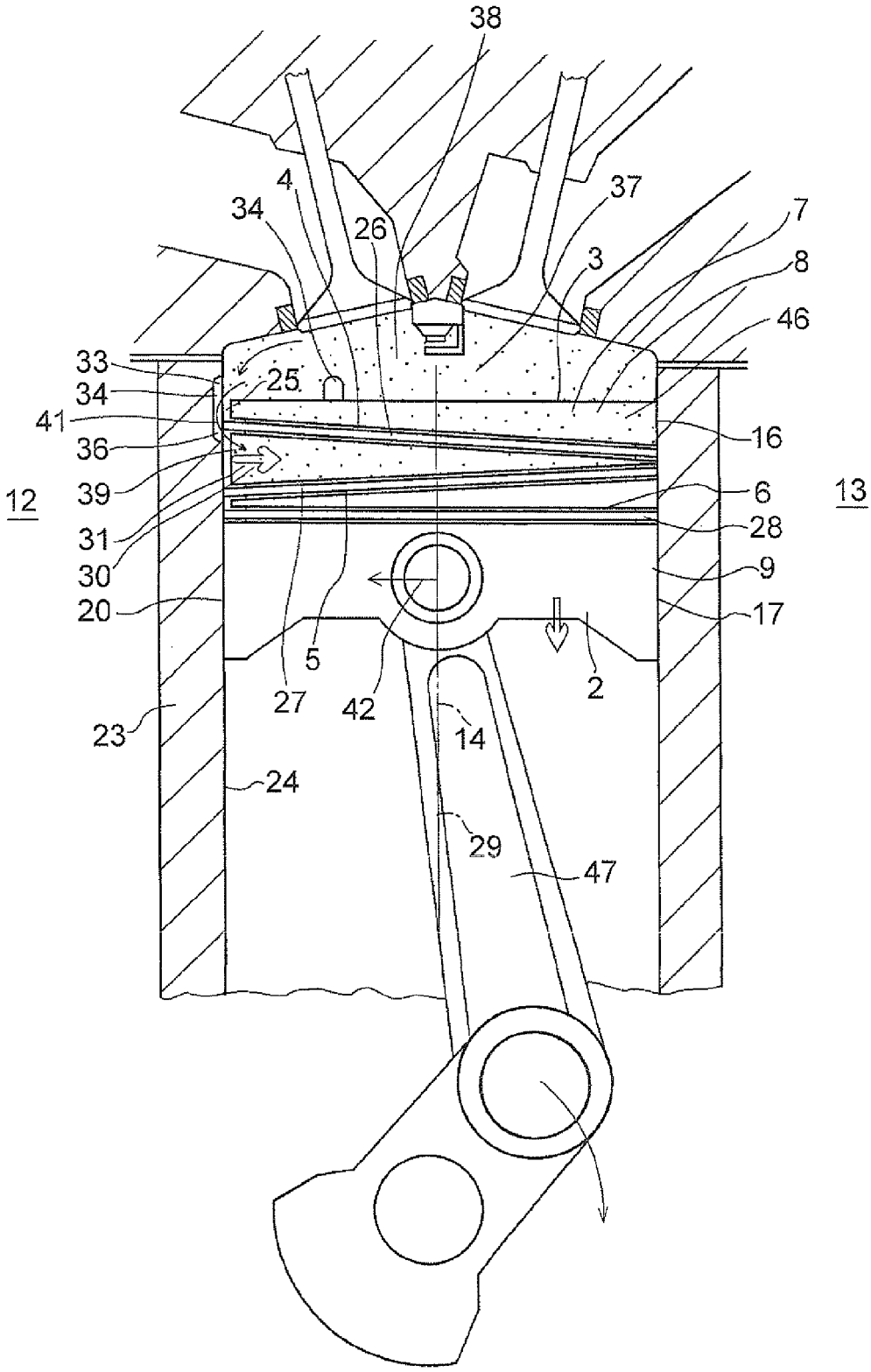
FIG. 3 is an explanatory diagram of operation in accordance with the example shown in FIG. 1.

Since the piston 2 has the above-described shape, when it is incorporated into a cylinder 23 and is in the upright posture, as shown in FIGS. 1 to 3, on the anti-thrust side 13 both the outer peripheral surface 16 of the piston upper body 8 and the outer peripheral surface 17 of the maximum-diameter portion of the skirt portion 9 are simultaneously in close abutment against with an inner surface 24 of the cylinder 23. On the other hand, on the thrust side 12, a clearance 25 is present between the outer peripheral surface 19 of the piston upper body 8 and the inner surface 24 of the cylinder 23.

A piston ring for compression is fitted in the piston ring groove 4 of the piston upper body 8. Namely, a first piston ring 26 is fitted in the piston ring groove 4 which is closest to the crown portion 3, and a second piston ring 27 is fitted in the piston ring groove 5 which is next closest. It should be noted that the first piston ring is the so-called top ring, and the second piston ring is the so-called second ring. Further, an oil scraper ring 28 is fitted in the lowest ring groove 6.

The piston ring groove 4 to which the first piston ring 26 is fitted and the piston ring groove 5 to which the second piston ring 27 is fitted are formed in such a manner as to be inclined with respect to a plane perpendicular to an axis 29 of the piston 2. Further, the piston ring groove 4 and the piston ring groove 5 are respectively provided in such a manner as to be inclined toward mutually opposite sides, and are provided in such a manner as to be gradually spaced apart from each other from the anti-thrust side 13 toward the thrust side 12.

Accordingly, a second land portion 30 which is encompassed between the piston ring groove 4 and the piston ring groove 5 is wider on the thrust side 12 and narrower on the anti-thrust side 13. The ring groove 6 to which the oil scraper ring 28 is fitted is parallel to the plane perpendicular to the piston axis 29.

FIGS. 1 to 4 show a state in which the piston 2 with the first piston ring 26, the second piston ring 27, and the oil scraper ring 28 respectively fitted to the piston ring grooves 4, 5, and 6 is incorporated into the cylinder 23, and the engine is being operated in an uptight posture.

In the piston 2, an annular gas chamber 31 is formed by being encompassed by the inner surface 24 of the cylinder 23 and the second land portion 30 formed between the first piston ring 26 and the second piston ring 27. This annular gas chamber 31 is wide on the thrust side 12 and is gradually narrower toward the anti-thrust side 13. This is to ensure that the piston 2 is pressed widely and strongly from the thrust side 12 by high pressure gas caused to flow into the annular gas chamber 31, to thereby reduce the gas flowing around to the anti-thrust side 13 and lessen the pushing back.

Next, a plurality of (3 to 4) recesses 34 are provided on the cylinder 23 on its inner surface 24 on the thrust side 12 at its upper portion 33 by being arranged along a circumferential direction 35. It should be noted that the recesses 34 are deep from the cylinder inner surface 24 and are formed concavely. These recesses 34 serve as passages of the gas pressure, which will be described later. The positions of these recesses 34 are set such that when the piston 2 is at the position of the top dead center or in the vicinity of the top dead center, the first piston ring 26 of the piston 2 is passing over these recesses 34. Thus, the arrangement provided is such that when the piston 2 is at the top dead center or in the vicinity of the top dead center and the first piston ring 26 is passing over the recesses 34, spaces formed between respective recessed spaces 36 of these recesses 34 and the outer peripheral surface of the first piston ring 26 constitute passages, such that a combustion chamber 37 above the piston 2 and the annular gas chamber 31 of the piston 2 communicate with each other, thereby allowing high pressure gas pressure 38 above the piston 2 to flow into the annular gas chamber 31 as indicated by an arrow 41. In addition, the aforementioned recesses 34 are provided so as not to be connected to the second piston ring 27 when the piston 2 is located at the top dead center. This is to ensure that the high pressure gas 38 of the combustion chamber 37 does not blow through downwardly from the piston 2. Now, during the operation of the engine, particularly when the piston 2 is located at the top dead center or in the vicinity of the top dead center, in the period from the final stage of the compression stroke to the initial stage of the expansion stroke, when the first piston ring 26 passes over the recesses 34, the high pressure gas 38 of the combustion chamber 37 above the piston 2 passes through the recesses 34 and flows into the annular gas chamber 31 of the piston 2. Concurrently with this, the piston 2 is set in a state in which it is supported by inflow high pressure gas 39 within the annular gas chamber 31 in the piston upper body 8, and is pressed from the thrust side 12 toward the anti-thrust side 13. The piston 2 is lowered in the expansion stroke in a state in which the outer peripheral surface 16 on the anti-thrust side 13 of the piston upper body 8 and the outer peripheral surface 17 of the maximum-diameter portion of the skirt portion 9 abut against the inner surface 24 of the cylinder 23 while the gas pressure 39 acting as described above is being held within the annular gas chamber 31.

According to the reciprocating engine 1 of this first embodiment constructed as described above, the piston 2 is formed such that the piston upper body 8 is provided so as to be off-centered toward the anti-thrust side 13, and the outer peripheral surface 16 of the piston upper body 8 and the outer peripheral surface 17 of the maximum-diameter portion of the skirt portion 9 are formed by being aligned on the vertical line 18. Therefore, as for the piston 2 incorporated in the cylinder 23, on the anti-thrust side 13 in the upright posture, the outer peripheral surface 16 of the piston upper body 8 and the outer peripheral surface 17 of the skirt portion 9 are in close abutment with the inner surface of the cylinder 23.

Figure 4:
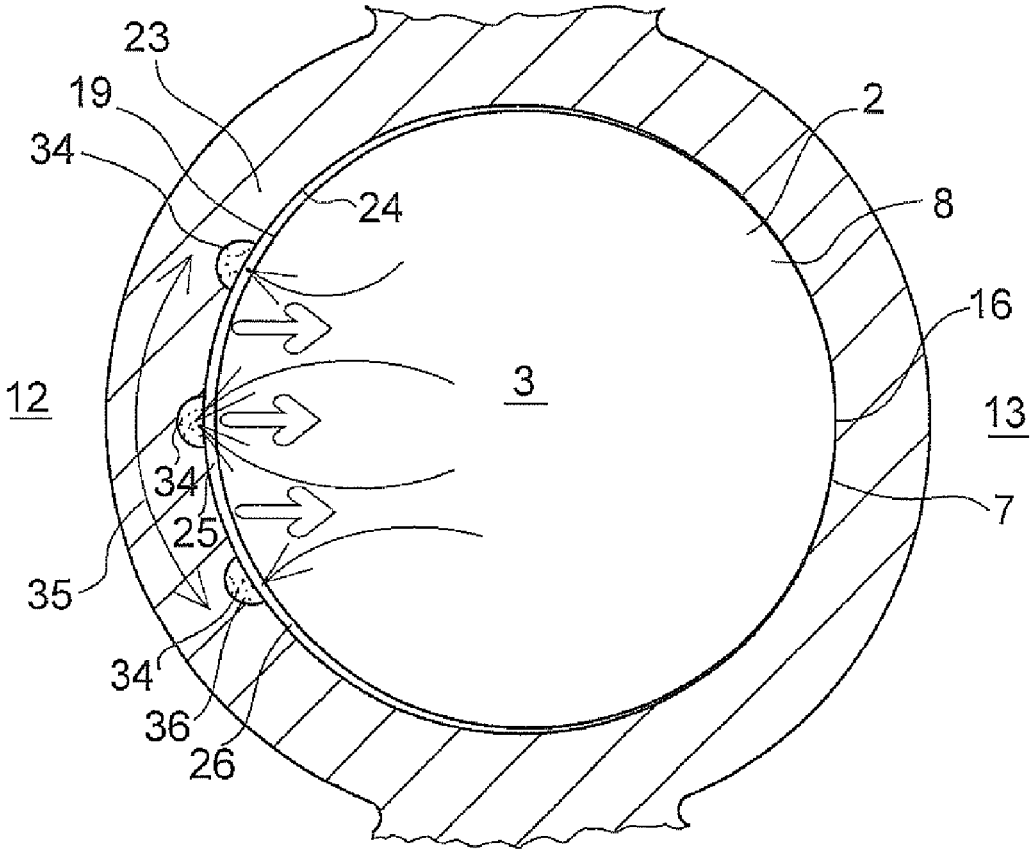
FIG. 4 is an explanatory transverse cross-sectional view of the example shown in FIG. 1.

If viewed from the top surface of the piston, on the anti-thrust side 13 the outer peripheral surface 16, particularly a top land 43, of the piston upper body 8 inscribes the inner surface 24 of the cylinder 23 in the shape of a circular arc, as shown in FIG. 4.

On the other hand, on the thrust side 32 the circular arc-shaped clearance 25 is present between the outer peripheral surface 19 of the piston upper body 8 and the inner surface 24 of the cylinder 23.

When the compressed gas and the expansion gas 38 act on the top surface of the piston 2 which is in the above-described state, the gas pressure acts on the top land 46 on the outer peripheral surface on the thrust side 12 of the piston upper body 8, but cannot act around onto the outer peripheral surface 16 on the anti-thrust side 13, i.e., onto the top land 46 on the anti-thrust side 13. The piston 2 is set in a state of being supported from the thrust side 12.

Accordingly, when the piston 2 has reached the position of the top dead center or the vicinity of the top dead center, and a moment load which would swing the piston 2 is applied to the piston 2, the piston 2 inscribes the inner surface of the cylinder 23 on the anti-thrust side 13 while maintaining its upright posture. When the piston 2 is in the above-described state at the top dead center or in the vicinity of the top dead center, the expansion gas 38 above the piston 2 flows into the annular gas chamber 31 of the piston 2 through the recesses 34 provided on the upper portion 33 on the thrust side 32 of the inner surface 24 of the cylinder 23. At this time, a thrust force (lateral pressure) 42 acts on the piston 2 owing to the tilting of a connecting rod 47 toward the thrust side 32, and tends to cause lateral runout toward the thrust side 32. However, the piston 2 is supported from the thrust side 32 by the high pressure gas 39 which flowed into and held in the aforementioned annular gas chamber 31, and is lowered while abutting against the inner surface 24 of the cylinder 23 on the anti-thrust side 13.

Namely, in the expansion stroke from the compression stroke, the piston 2 is lowered with its lateral swing suppressed despite the inversion of the tilt of the connecting rod 44 and the inversion of the moment load. Namely, on the thrust side 32 where the lateral pressure acts, the piston upper body 8 is resiliently supported by the high pressure gas 39 which flowed into and held in the annular gas chamber 31, and the piston 2 is hence lowered in a state of being in close abutment with the inner surface 24 of the cylinder 23 on the anti-thrust side 45 and without causing "runout." For this reason, lateral runout and swinging are suppressed for the piston 2, and the collision with the inner surface 24 of the cylinder 23 is suppressed.

Consequently, the friction loss between the piston 2 and the inner surface 24 of the cylinder 23, the friction loss between the first piston ring 26 and the piston 2, and the friction loss between the first piston ring 26 and the inner surface 24 of the cylinder 23 are substantially reduced. In addition, since the vibration of the piston 2 is suppressed, the blow through of the blowby gas is prevented.

In addition, in the expansion stroke, on the thrust side 12 where the thrust force 42 acts, the piston 2 is, of course, supported by the high pressure gas 39 of the annular gas chamber 31 so that the friction loss between the piston 2 and the inner surface 24 of the cylinder 23 is reduced. Since the piston 2 has the piston upper body 8 supported by the high pressure gas 39 of the annular gas chamber 31 particularly on the thrust side 12, the area of contact between the piston 2 and the inner surface 24 of the cylinder 23 is small, with the result that the drag resistance of oil becomes small.

Furthermore, as for the piston 2, since the piston upper body 8 having the crown portion 3, which is subjected to the high-temperature, high-pressure gas pressure, is in contact with the inner surface 24 of the cylinder 23 on the anti-thrust side 13, as compared with the conventional contact by only the piston rings, the area of contact with the inner surface 24 of the cylinder 23 is large, and the heat fetched from the piston 2 to the cylinder 23 is large, thereby allowing the cooling of the top surface of the piston 2 to be performed effectively. Therefore, it is possible to prevent abnormal combustion, and the heat rise of the overall engine is low, so that the intake effect can be secured satisfactorily. In addition, in the initial stage of the expansion stroke of the engine operation, when the piston 2 is located at the top dead center or in the vicinity of the top dead center, and the first piston ring 26 of the piston 2 passes over the plurality of recesses 34 provided on the cylinder 23, the gas pressure 38 above the piston 2 rapidly flows into the annular gas chamber 31 of the piston 2, so that flow occurs in the gas during combustion in the combustion chamber 37 and disturbs the gas, thereby enhancing the combustion rate.

Figure 7:
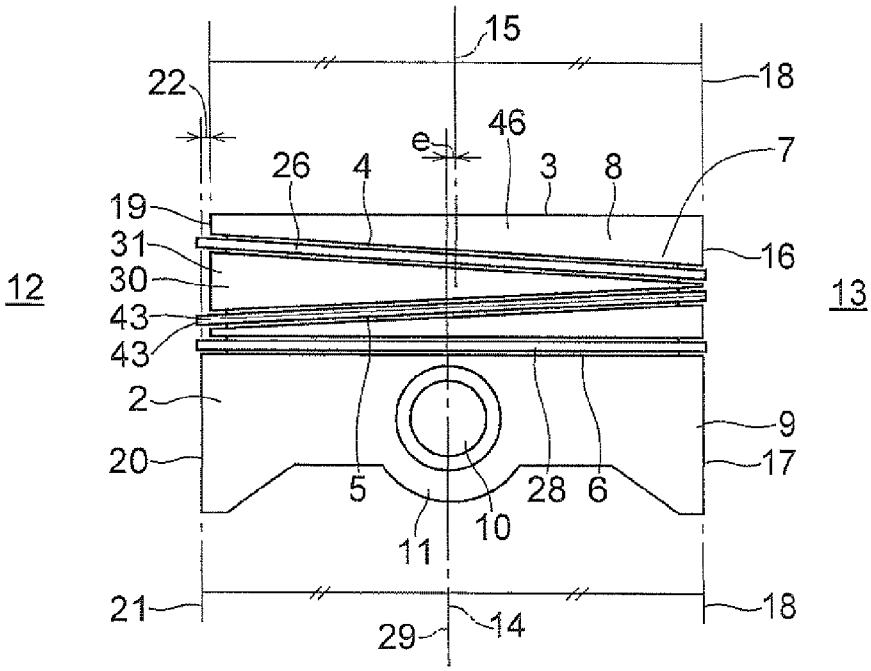
FIG. 7 is an explanatory diagram of the piston in accordance with another example of the mode for carrying out the invention.
Figure 8:
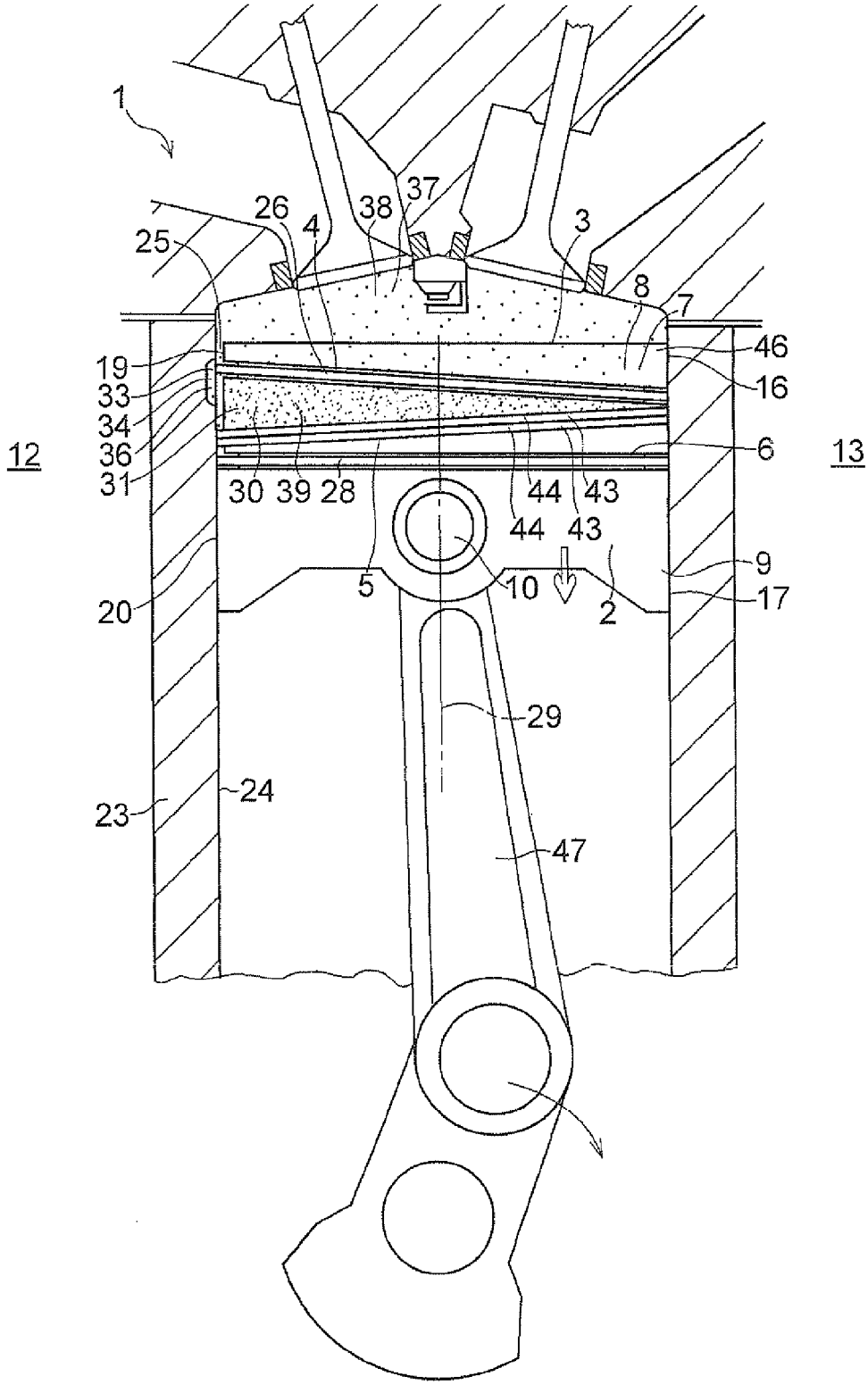
FIG. 8 is an explanatory longitudinal cross-sectional view of the example shown in FIG. 7.
Figure 9:
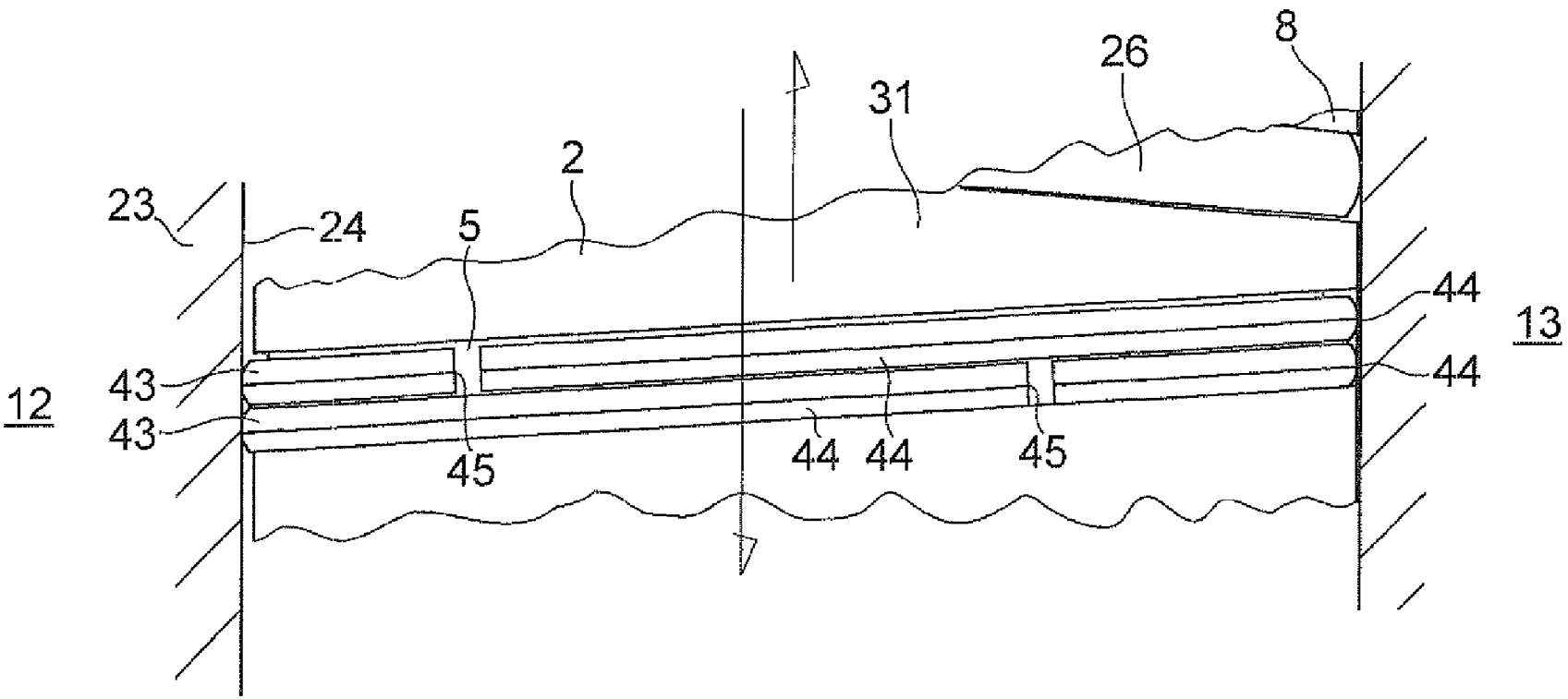
FIG. 9 is a partly enlarged explanatory diagram of the other example shown in FIG. 8.

In FIGS. 7, 8, and 9, in the reciprocating engine 1 in which the second piston ring of the piston 2 consists of a superposed structure of two thin piston rings 43, the two thin piston rings 43 are inserted, as shown in FIGS. 7, 8, and 9, instead of the single piston ring 27 inserted in the piston ring groove 5 of the piston 2 shown in FIG. 1.

According to this reciprocating engine 1, since the two piston rings 43 are superposed and inserted in the piston ring groove 5, oil enters and is present between the respective piston rings 43. For this reason, the formation of an oil film with respect to the inner surface 24 of the cylinder 23 is excellent, the gas pressure seal is made more reliable, and satisfactory fluid lubrication is constantly ensured between the cylinder inner surface 24 and the piston rings 43.

Although the piston ring groove 5 is formed in such a manner as to be inclined with respect to the axis 29 of the piston 2, the respective piston rings 43 operate independently, and are respectively in contact with the inner surface 24 of the cylinder 23.

For this reason, double seal portions 44 are formed, thereby rendering the gas seal more reliable.

Furthermore, as abutments 45 of the respective piston rings 43 are offset from each other, a labyrinth effect is produced between the abutments, thereby preventing the generation of propane gas from the abutments 45.

Accordingly, according to the reciprocating engine 1 such as the one shown in FIG. 8, the high pressure gas 39 which flowed into the annular gas chamber 31 of the piston 2 is held more reliably. Although in the expansion stroke of the engine operation the piston 2 is subjected to a large thrust force 42 on the thrust side 12, the piston 2 is lowered in a state in which the piston upper body 8 of the piston 2 is floated from the inner surface 24 of the cylinder 23 by virtue of the high pressure gas 39 which flowed into and held in the annular gas chamber 31.

For this reason, the friction loss is further reduced also on the thrust side 12 where the thrust force 42 acts.

As for the piston 2 which is adapted to move with the outer peripheral surface 16 of the piston upper body 8 and the outer peripheral surface 17 of the maximum-diameter portion of the skirt portion 9 in contact with the inner surface 24 of the cylinder 23, since the second piston rings 43 are superposed in the form of two rings, and the high pressure gas 39 can be held reliably, the piston 2 is resiliently pressed toward the anti-thrust side 13 by this high pressure gas 39 and is lowered along the inner surface 24 on the anti-thrust side 13. The piston 2 is suppressed from swinging and is lowered gently and softly.

Figure 12:
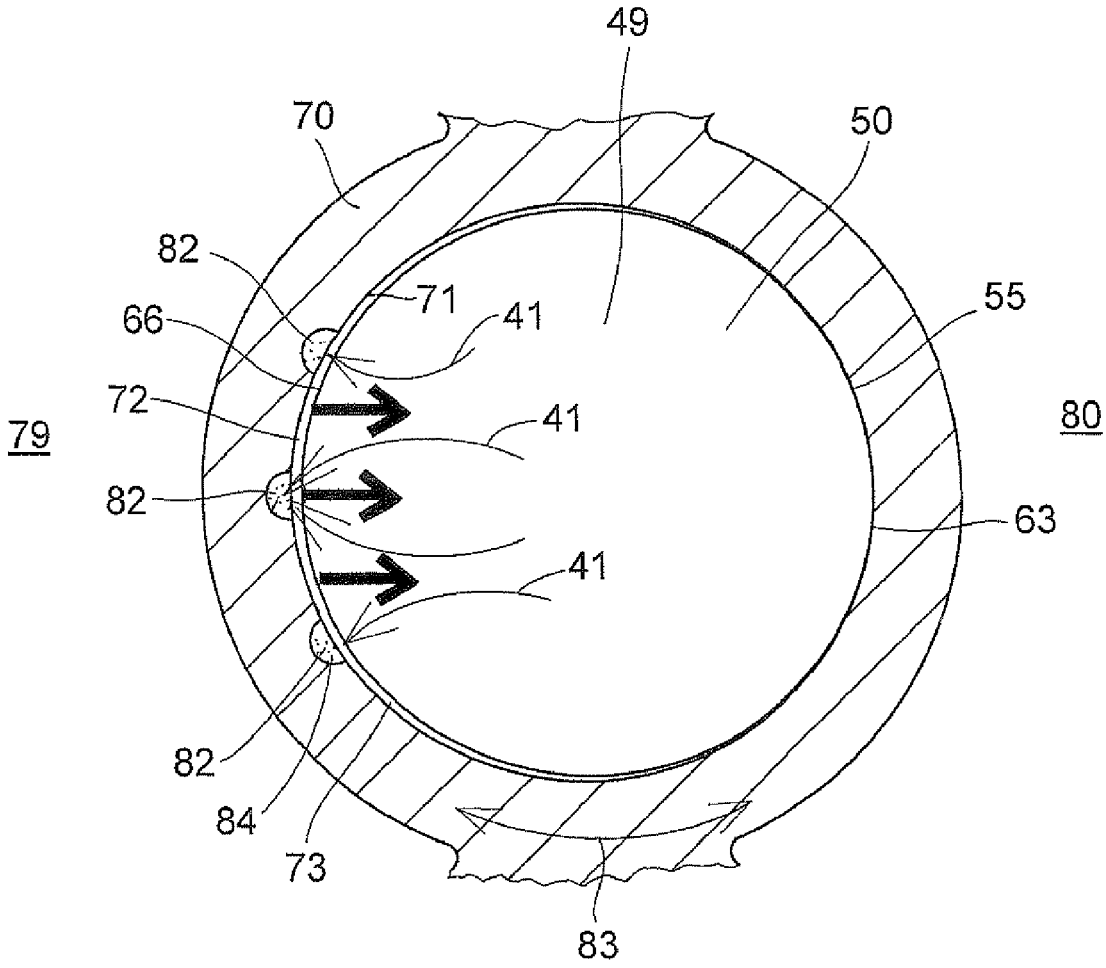
FIG. 12 is an explanatory transverse cross-sectional view of the still other example shown in FIG. 10.
Figure 13:
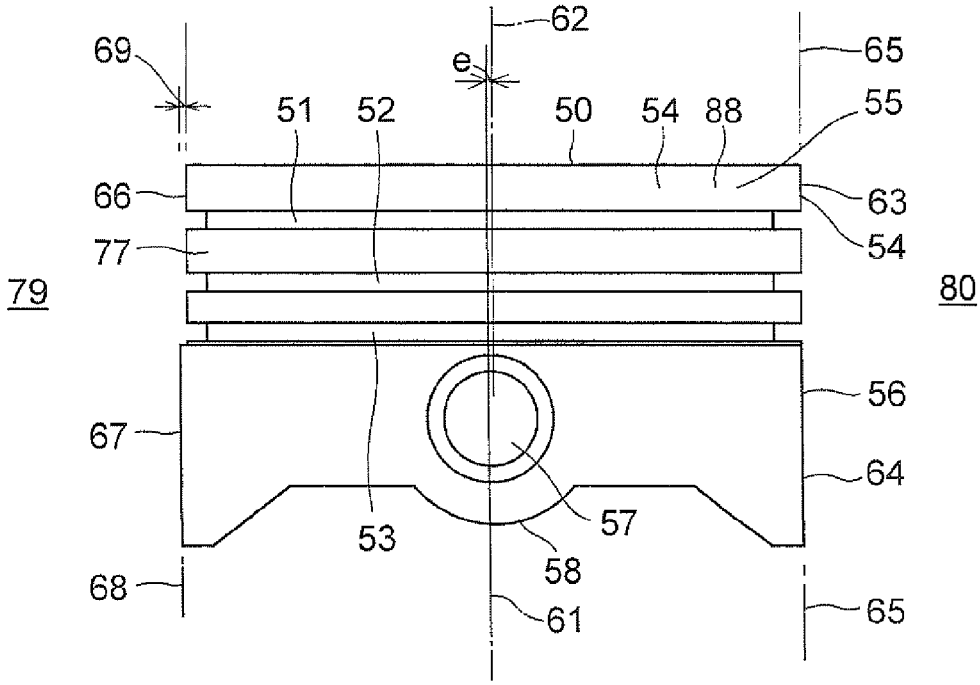
FIG. 13 is an explanatory diagram of mainly the piston in accordance with the still other embodiment shown in FIG. 10.
Figure 14:
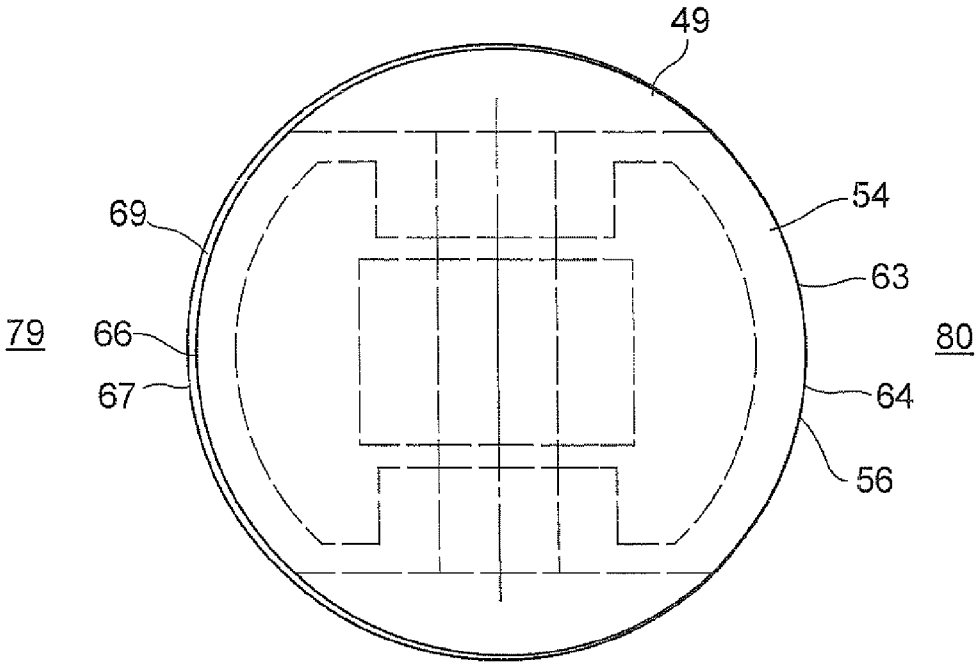
FIG. 14 is a plan view of the piston shown in FIG. 13.

A reciprocating engine 48 in accordance with a second embodiment is shown in FIGS. 10 to 14, and a piston 49 of the reciprocating engine 48 of this embodiment is shown in FIGS. 13 and 14, in particular.

The piston 49 includes a piston upper body 55 made up of a crown portion 50 for receiving combustion pressure and a land portion 54 having piston ring grooves 51, 52, and 53, as well as a skirt portion 56 formed on the lower side of this piston upper body 55, and a pin boss portion 58 for supporting a piston pin 57.

Reference numeral 79 denotes the thrust side, and reference numeral 80 denotes the anti-thrust side.

As for the piston 49, the aforementioned piston upper body 55 is provided so as to be off-centered toward the anti-thrust side 80 with respect to a center line 61 of the piston 49. Reference numeral 62 denotes a center line of the piston upper body 55. The piston 49 in an upright posture is formed such that, on the anti-thrust side 80, an outer peripheral surface 63 of the aforementioned piston upper body 55 and an outer peripheral surface 64 of a maximum-diameter portion of the skirt portion 56 are aligned on a vertical line 65.

Meanwhile, on the thrust side 79, an outer peripheral surface 66 of the piston upper body 55 is located inwardly of a vertical line 68 passing through an outer peripheral surface 67 of the maximum-diameter portion of the skirt portion 56, so that there is a clearance 69 therebetween. Since the piston 49 has the above-described shape, when it is incorporated into a cylinder 23 and is in the upright posture, as shown in FIG. 10, on the anti-thrust side 80 both the outer peripheral surface 63 of the piston upper body 55 and the outer peripheral surface 64 of the maximum-diameter portion of the skirt portion 56 are in close abutment against with an inner surface 71 of the cylinder.

On the other hand, on the thrust side 79, a clearance 72 is present between the outer peripheral surface 66 of the piston upper body 55 and the inner surface 71 of the cylinder 70.

Piston rings for compression are respectively fitted in the piston ring grooves 51 and 52 of the piston upper body 55. A first piston ring 73 is fitted in the piston ring groove 51 which is closest to the crown portion 50, and a second piston ring 74 is fitted in the piston ring groove 52 which is next closest. It goes without saying that the first piston ring 73 is the top ring for compression, and that the second piston ring 74 is the second ring for compression. Further, an oil scraper ring 75 is fitted in the lowest ring groove 53. In the above-described piston 49 the piston ring groove 51 to which the first piston ring 73 is fitted and the piston ring groove 52 to which the second piston ring 74 is fitted are both formed in parallel to a plane perpendicular to an axis 76 of the piston 49. A second land portion 77 having a necessary interval is provided between the piston ring groove 51 and the piston ring groove 52 mentioned above, and an annular gas chamber 78, which will be described later, is formed by this second land portion 77.

Figure 10:
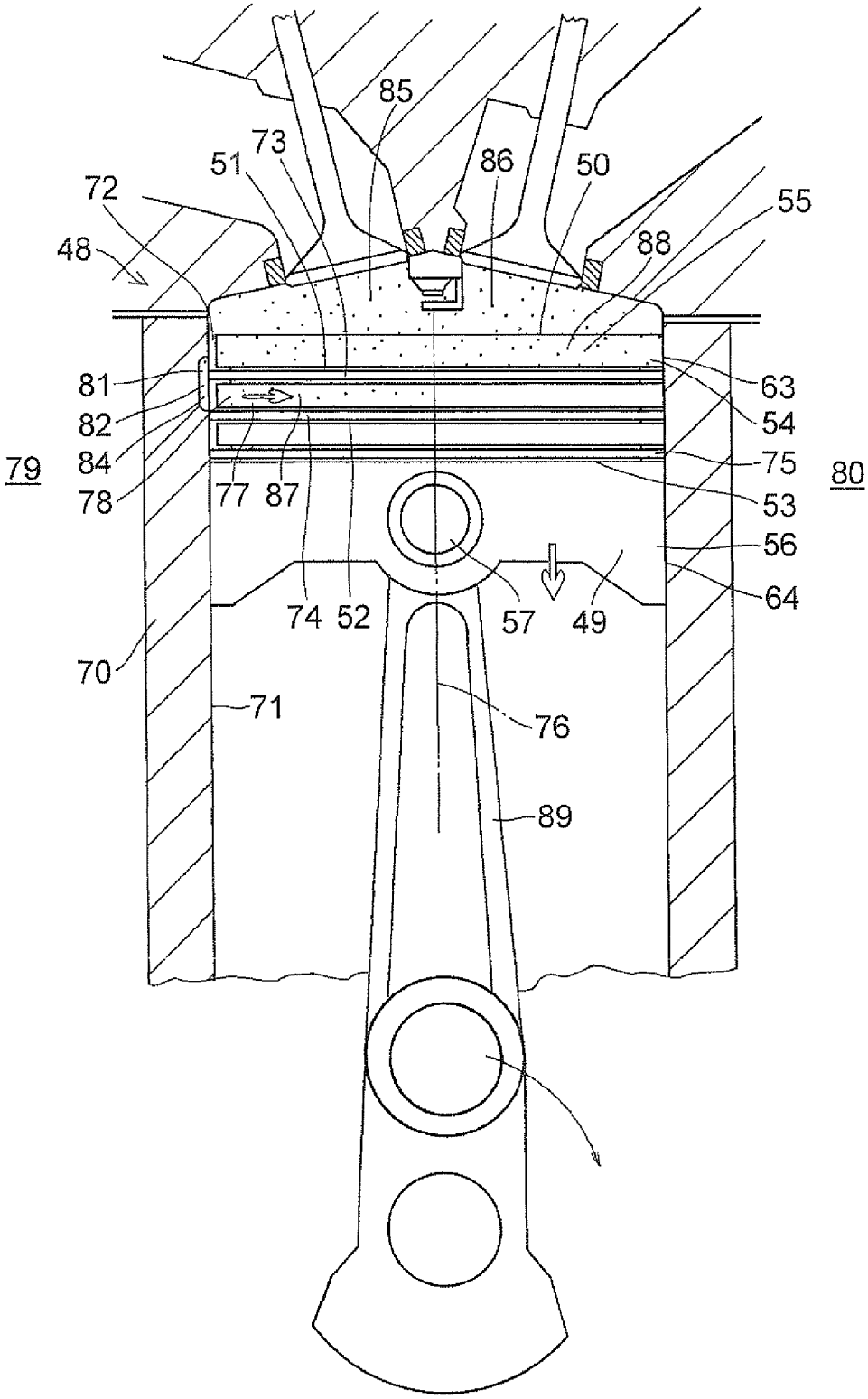
FIG. 10 is an explanatory longitudinal cross-sectional view of still another example of the mode for carrying out the invention.
Figure 11:
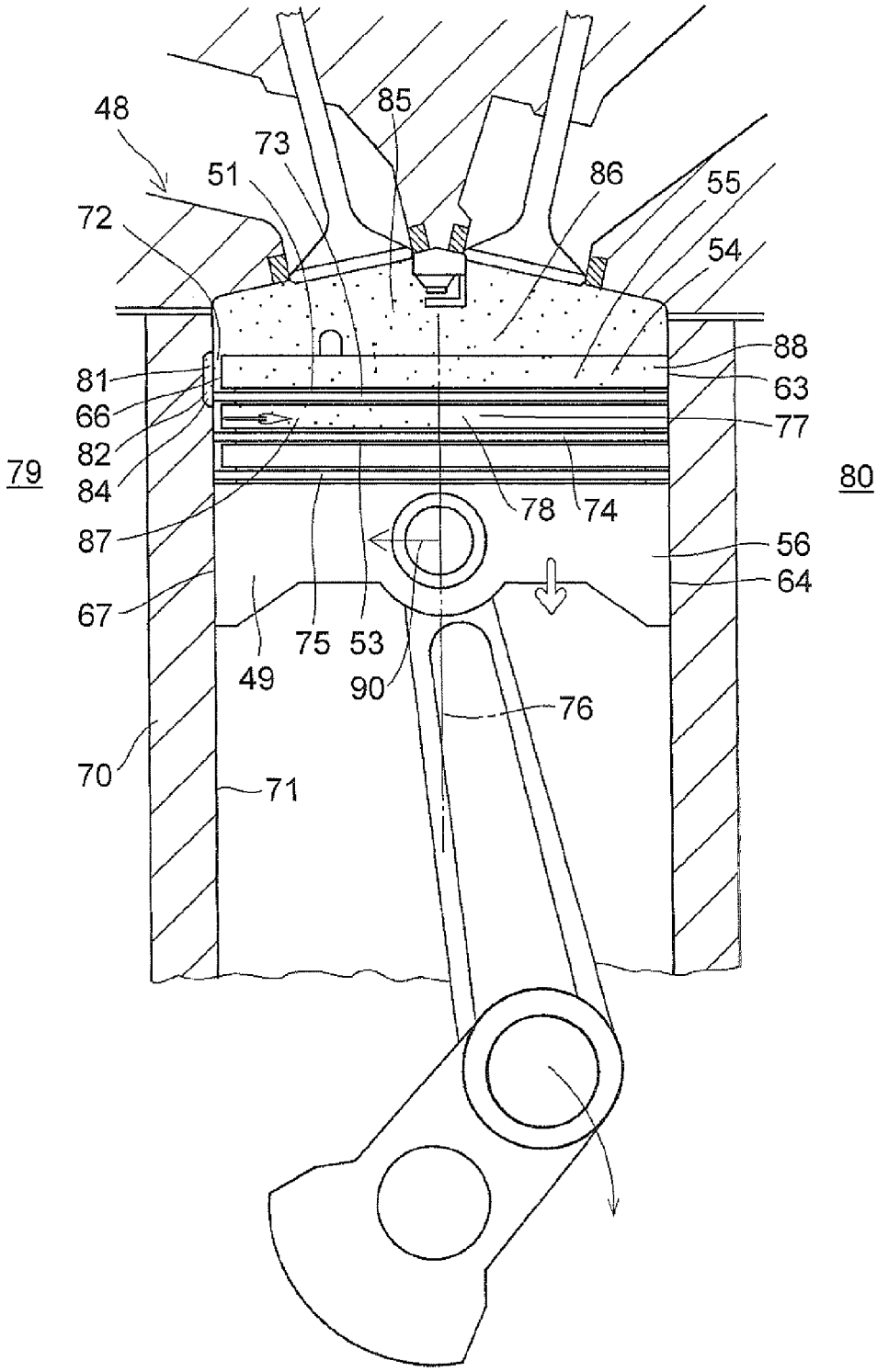
FIG. 11 is an explanatory diagram of operation in accordance with the still other example shown in FIG. 10.

FIG. 10 shows a state in which the piston 49 with the first piston ring 73, the second piston ring 74, and the oil scraper ring 75 respectively fitted to the piston ring grooves 51, 52, and 53 is incorporated into the cylinder 70, and the engine is being operated in an uptight posture.

The annular gas chamber 78 is formed by being encompassed by the inner surface 71 of the cylinder 70 and the second land portion 77 formed between the first piston ring 73 and the second piston ring 74. This annular gas chamber 78 has a parallel shape from the thrust side 79 toward the anti-thrust side 80.

Next, a plurality of (3 to 4) recesses 82 formed in such a manner as to be concaved from the inner surface 71 are provided on the inner surface 71 on the thrust side 79 of the cylinder 70 at an upper portion 81 of the cylinder 70 by being arranged along a circumferential direction 83. The positions of these recesses 82 are set such that when the piston 49 has reached the position of the top dead center or the vicinity of the top dead center, the first piston ring 73 of the piston 49 is passing over these recesses 82.

Thus, the arrangement provided is such that when the piston 49 is at the top dead center or in the vicinity of the top dead center and the first piston ring 73 is passing over the recesses 82, spaces formed between respective recessed spaces 84 of these recesses 82 and the outer peripheral surface of the first piston ring 73 constitute passages, such that a combustion chamber 85 above the piston 49 and the annular gas chamber 78 of the piston 49 communicate with each other, thereby allowing high pressure gas 86 above the piston 49 to flow into the annular gas chamber 78.

In addition, the aforementioned recesses 82 are provided so as not to be connected to the second piston ring 74 when the piston 49 is located at the top dead center. This is to ensure that the high pressure gas 86 of the combustion chamber 85 does not blow through downwardly from the piston 49.

Now, during the operation of the engine, particularly when the piston 49 is located at the top dead center or in the vicinity of the top dead center, in the period from the final stage of the compression stroke to the initial stage of the expansion stroke, when the first piston ring 73 passes over the recesses 82, the high pressure gas 86 being burnt and expanded in the combustion chamber 85 above the piston 49 passes through the recesses 82 and flows into the annular gas chamber 78 of the piston 49. Concurrently with this, the piston 49 is set in a state in which it is supported by high pressure gas 87, which flowed into the annular gas chamber 78 in the piston upper body 55, and is pressed from the thrust side 79 toward the anti-thrust side 80. The piston 49 is lowered in the expansion stroke in a state in which the outer peripheral surface 63 on the anti-thrust side 80 of the piston upper body 55 and the outer peripheral surface 64 of the maximum-diameter portion of the skirt portion 56 abut against the inner surface 71 of the cylinder 70 while the high pressure gas 87 acting as described above is being held within the annular gas chamber 78.

According to the reciprocating engine 1 of this second embodiment constructed as described above, the piston 49 is formed such that the outer peripheral surface 63 of the piston upper body 55 and the outer peripheral surface 64 of the maximum-diameter portion of the skirt portion 56 are formed in such a manner as to be aligned on the vertical line 65 on the anti-thrust side 80. Therefore, as for the piston 49 incorporated in the cylinder, on the anti-thrust side 80 in the upright posture, the outer peripheral surface 63 of the piston upper body 55 and the outer peripheral surface 64 of the maximum-diameter portion of the skirt portion 56 are in abutment with the inner surface 71 of the cylinder 70. If this is viewed from the top surface of the piston, on the anti-thrust side 80 the outer peripheral surface 63, particularly a top land 88, of the piston upper body 55 inscribes the inner surface 71 of the cylinder 70 in the shape of a circular arc, as shown in FIG. 12.

On the other hand, on the thrust side 79 the circular arc-shaped clearance 72 is present between the outer peripheral surface 66 of the piston upper body 55 and the inner surface 71 of the cylinder 70.

When the compressed gas and the expansion gas 86 act on the top surface of the piston 49 which is in the above-described state, the gas pressure acts on the top land 88 on the outer peripheral surface 66 on the thrust side 79 of the piston upper body 55, but cannot act around onto the outer peripheral surface 63 on the anti-thrust side 80, i.e., onto the top land 88 on the anti-thrust side 80. The piston 49 is set in a state of being supported from the thrust side 79.

Accordingly, when the piston 49 has reached the position of the top dead center or the vicinity of the top dead center, and a moment load which would swing the piston 49 is applied to the piston 49, the piston 49 inscribes the inner surface of the cylinder 70 on the anti-thrust side 80 while maintaining its upright posture. When the piston 49 is in the above-described state at the top dead center or in the vicinity of the top dead center, the high-pressure expansion gas 86 above the piston 49 flows into the annular gas chamber 78 of the piston 49 through the recesses 82 provided on the upper portion 81 on the thrust side 79 of the inner surface 71 of the cylinder 70. At this time, a thrust force (lateral pressure) 90 acts on the piston 49 owing to the tilting of a connecting rod 89 toward the thrust side 79, and tends to cause lateral runout toward the thrust side 79. However, the piston 49 is lowered while suppressing the swinging and maintaining its upright posture and with its anti-thrust side 80 abutting against the inner surface 71 of the cylinder 70 by being supported from the thrust side 79 by the high pressure gas 87 which flowed into and held in the annular gas chamber 78.

Namely, in the expansion stroke from the compression stroke, the piston 49 is lowered with its swinging suppressed despite the inversion of the tilt of the connecting rod 89 and the inversion of the moment load. Namely, on the thrust side 49 where the lateral pressure acts, the piston upper body 55 is resiliently supported by the high pressure gas 87 which flowed into and held in the annular gas chamber 78, and the piston 49 is hence lowered in a state of being in close abutment with the inner surface 71 of the cylinder 70 on the anti-thrust side 90 without causing "runout." For this reason, lateral runout and swinging are suppressed for the piston 49, and the collision with the inner surface 71 of the cylinder 70 is suppressed.

Consequently, the friction loss between the piston 49 and the inner surface 71 of the cylinder 70, the friction loss between the first piston ring 59 and the piston 49, and the friction loss between the first piston ring 59 and the inner surface 71 of the cylinder 70 are substantially reduced. In addition, since the vibration of the piston 49 is suppressed, the blow through of the blowby gas is prevented.

The invention claimed is:

1. A reciprocating engine having a piston, comprising:

a piston upper body made up of a crown portion for receiving combustion pressure and a land portion having piston rings fitted thereon; and a skirt portion formed on a lower side of said piston upper body, wherein said piston upper body is formed so as to be off-centered toward an anti-thrust side with respect to a center line of a piston, and, on the anti-thrust side an outer peripheral surface of said piston upper body and an outer peripheral surface of a maximum-diameter portion of said skirt portion are formed by being aligned on a vertical line, such that, in a state in which the piston is accommodated in an upright posture in a cylinder, on the anti-thrust side the outer peripheral surface of said piston upper body and the outer peripheral surface of the maximum-diameter portion of said skirt portion are in close abutment against with an inner surface of said cylinder, and on a thrust side a clearance is created between the outer peripheral surface of said piston upper body and an inner surface of said cylinder, an annular gas chamber being formed on a second land portion between a first piston ring fitted on the outer peripheral surface of said piston upper body and a second piston ring, a plurality of recesses being formed in an upper portion on the thrust side of the inner surface of said cylinder, whereby when said piston is located at a top dead center or in a vicinity of the top dead center, high pressure gas above said piston is allowed to flow into said annular gas chamber, said piston is supported from the thrust side by the high pressure gas flowing into the gas chamber, and said piston is lowered such that the outer peripheral surface of said piston upper body and the skirt portion are in abutment with the inner surface of said cylinder on the anti-thrust side.

* * * * *